US011596049B2

(12) United States Patent
McDonald

(10) Patent No.: US 11,596,049 B2
(45) Date of Patent: Feb. 28, 2023

(54) METHODS AND APPARATUSES FOR EMITTING ELECTRONS FROM A HOLLOW CATHODE

(71) Applicant: The Government of the United States, as represented by the Secretary of the Navy, Washington, DC (US)

(72) Inventor: Michael McDonald, Washington, DC (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 17/183,328

(22) Filed: Feb. 23, 2021

(65) Prior Publication Data

US 2021/0204388 A1 Jul. 1, 2021

Related U.S. Application Data

(63) Continuation of application No. PCT/US2019/049326, filed on Sep. 3, 2019.

(60) Provisional application No. 62/725,846, filed on Aug. 31, 2018.

(51) Int. Cl.
*H05H 1/48* (2006.01)

(52) U.S. Cl.
CPC ..... *H05H 1/48* (2013.01)

(58) Field of Classification Search
None
See application file for complete search history.

(56) References Cited

U.S. PATENT DOCUMENTS 6,446,883 B1 * 9/2002 Huang ..... G01N 21/714 239/424.5
2004/0084422 A1 * 5/2004 Beckmann ..... H01J 37/32009 219/121.36
2009/0218212 A1 * 9/2009 Denpoh ..... C23C 16/509 156/345.43

* cited by examiner

*Primary Examiner* — Ashok Patel
(74) *Attorney, Agent, or Firm* — US Naval Research Laboratory

(57) ABSTRACT

Methods and apparatuses for emitting electrons from a hollow cathode are provided. The cathode includes a plasma holding region configured to hold a plasma, a gas supply source configured to supply gas to the plasma holding region, and an orifice plate disposed on a periphery of the plasma holding region. The orifice plate comprises a plurality of openings constructed to receive electrons from the plasma. The plurality of openings decouple gas conductance and electrical conductance across the orifice plate. The diameters of the plurality of openings are within a range of 20%-60%, inclusive, of a diameter of a circular opening with an area equal to a sum of the areas of the plurality of openings.

18 Claims, 10 Drawing Sheets

METHODS AND APPARATUSES FOR EMITTING ELECTRONS FROM A HOLLOW CATHODE

BACKGROUND

Field of the Invention

The present application relates generally to hollow cathodes for spacecraft propulsion systems.

Description of Related Art

In spacecraft propulsion, electric thrusters such as Hall thrusters and gridded ion thrusters have become increasingly popular especially for situations where a chemical based propulsion system is unfeasible or unwise. FIGS. 1A and 1B are cross-sectional views that illustrate the basic operation a Hall thruster 100 to show the role of the hollow cathode; however, the orifice plates discussed below may be used in other electric propulsion systems. A hollow cathode 102 is disposed proximate to a thrust chamber 104 formed by a dielectric insulating wall made of dielectric materials such as boron nitride, borosil, and sometimes alumina, among others. An N magnet 110 is disposed coaxially with axis A which represents the thrust center line of thruster 110. An S magnet is disposed on the periphery of wall 104 to create a magnetic field B that runs vertically in FIG. 1A. At least some of the electrons 114 emitted from the hollow cathode 102 are pulled into and trapped in the magnetic field (as shown FIG. 1A). Anodes 106A and 106B serve to supply the cavity within wall 104 with gas 108 which has a positive charge such that, due to the presence of the electrons 114 trapped in the magnetic field, the gas 108 is rapidly accelerated by electrostatic forces to the right in FIGS. 1A and 1B. Gas 108 and electrons 114 recombine near the opening of the wall 104, and the resulting product 116 is ejected from the thruster 100 creating a force in the opposite direction.

Electrons flowing from the hollow cathode 102 are thus an indispensable element in a Hall thruster. FIGS. 1A and 1B show an outline of a keeper to represent the hollow cathode 102. In prior art devices, the outer surface of the keeper is also the peripheral outer surface of the hollow cathode 102 and electrons 114 escape through a single orifice in the keeper. There are two ways to turn on the cathode. In both cases the keeper is positively biased so as to draw electrons generated within the hollow cathode 112 out through the orifice. In both cases gas is fed into the hollow cathode. The first method to turn on the hollow cathode 112 uses a heater to bring a thermionic electron emitter to emission temperature. Thermionic electrons are drawn toward the keeper and acquire enough energy to ionize the gas, generating a plasma. At this point the heater may be turned off and the current across the plasma is sufficient to maintain the hot cathode temperature. This method uses a moderate gas flow and ignition keeper bias. The second method uses no heater to turn on the hollow cathode 112. A larger gas flow is required to produce a large gas pressure in the gap between the keeper and the electron generating portion of the hollow cathode 112, and a larger keeper bias is required to achieve electrical breakdown. The current drawn across the high voltage discharge heats the electron emitter to thermionic emission temperatures, at which point the keeper bias and gas flow required to sustain the discharge may be reduced to more moderate levels comparable to the heated cathode case. An electron source capable of supplying sufficient electron current to sustain the electron 114 discharge is also required. A smaller keeper orifice reduces the gas flow required to sustain the minimum pressure for ignition in either the heated or heaterless case, but also increases the resistive losses during operation by forcing the electron current to exit through a smaller diameter opening with correspondingly higher resistance. A larger orifice reduces resistive losses while requiring a higher gas flow for ignition and subsequent stable operation. It would be desirable for efficient cathode operation to reduce the required gas flow to ignite and sustain the hollow cathode 102 while still providing a low-resistance path for the electron current to leave the hollow cathode 102 through the keeper.

SUMMARY OF THE INVENTION

One or more the above limitations may be diminished by structures and methods described herein.

Methods and apparatuses for emitting electrons from a hollow cathode are provided. The cathode includes a plasma holding region configured to hold a plasma, a gas supply source configured to supply gas to the plasma holding region, and an orifice plate disposed on a periphery of the plasma holding region. The orifice plate comprises a plurality of openings constructed to receive electrons from the plasma. The plurality of openings decouple gas conductance and electrical conductance across the orifice plate. The diameters of the plurality of openings are within a range of 20%-60%, inclusive, of a diameter of a circular opening with an area equal to a sum of the areas of the plurality of openings.

BRIEF DESCRIPTION OF THE DRAWINGS

The teachings claimed and/or described herein are further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

Figure 1A:
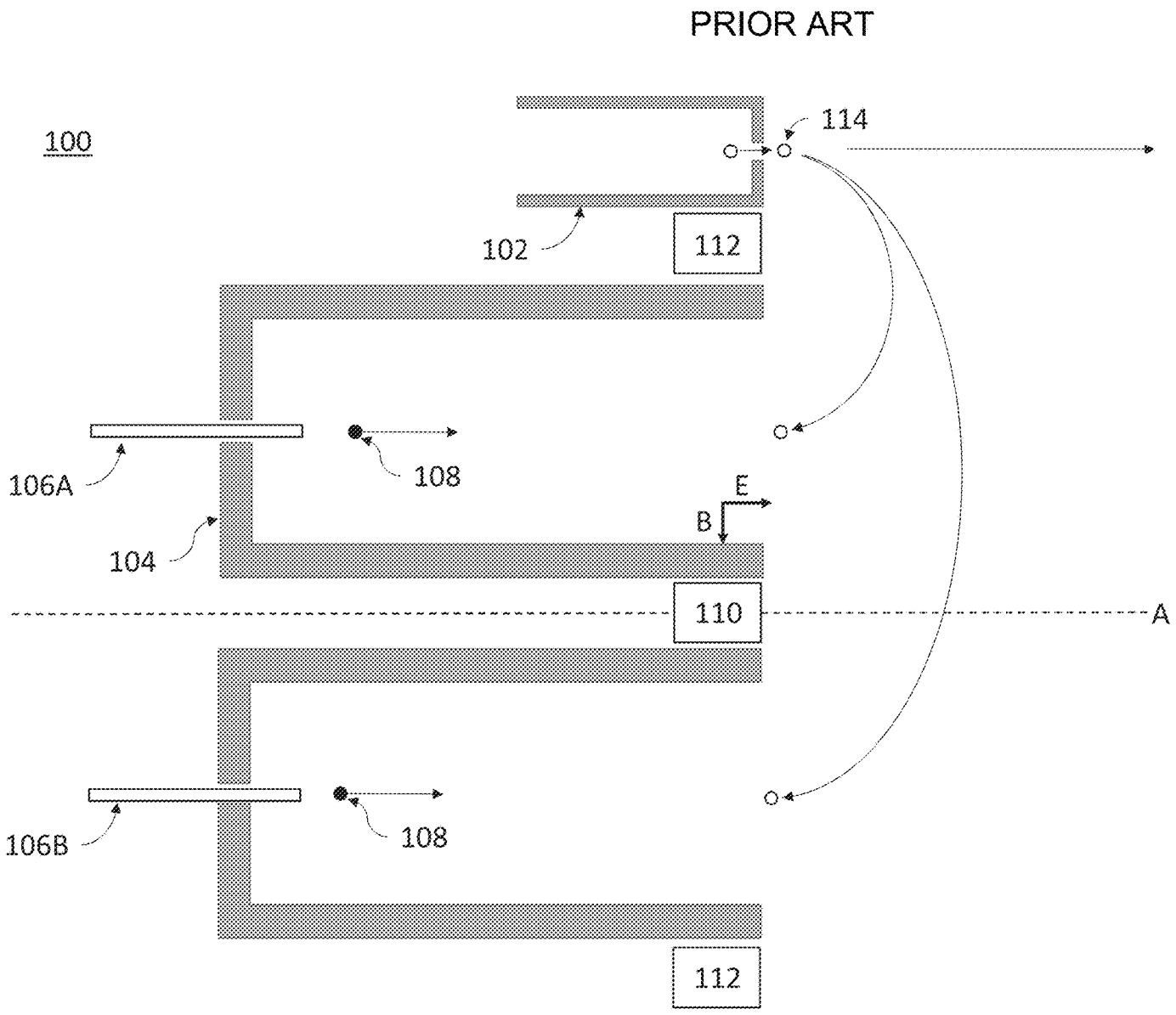
FIGS. 1A-1B are cross-sectional views explaining the operation of a hall thruster.
Figure 1B:
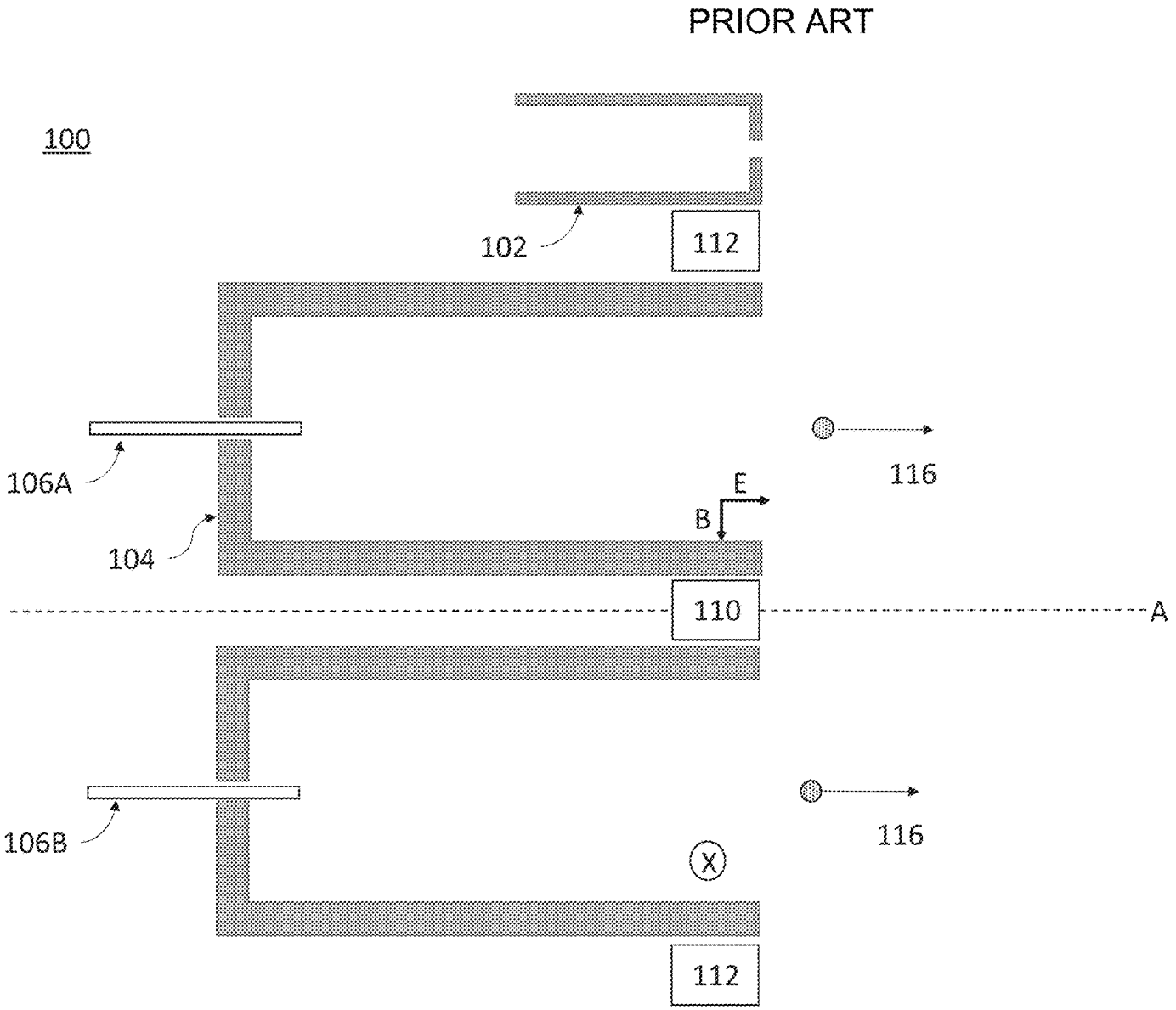

Different ones of the Figures may have at least some reference numerals that are the same in order to identify the same components, although a detailed description of each such component may not be provided below with respect to each Figure.

DETAILED DESCRIPTION OF THE PREFERRED EMBODIMENTS

In accordance with example aspects described herein are hollow cathodes that include a keeper orifice that has a plurality of openings.

Figure 2:
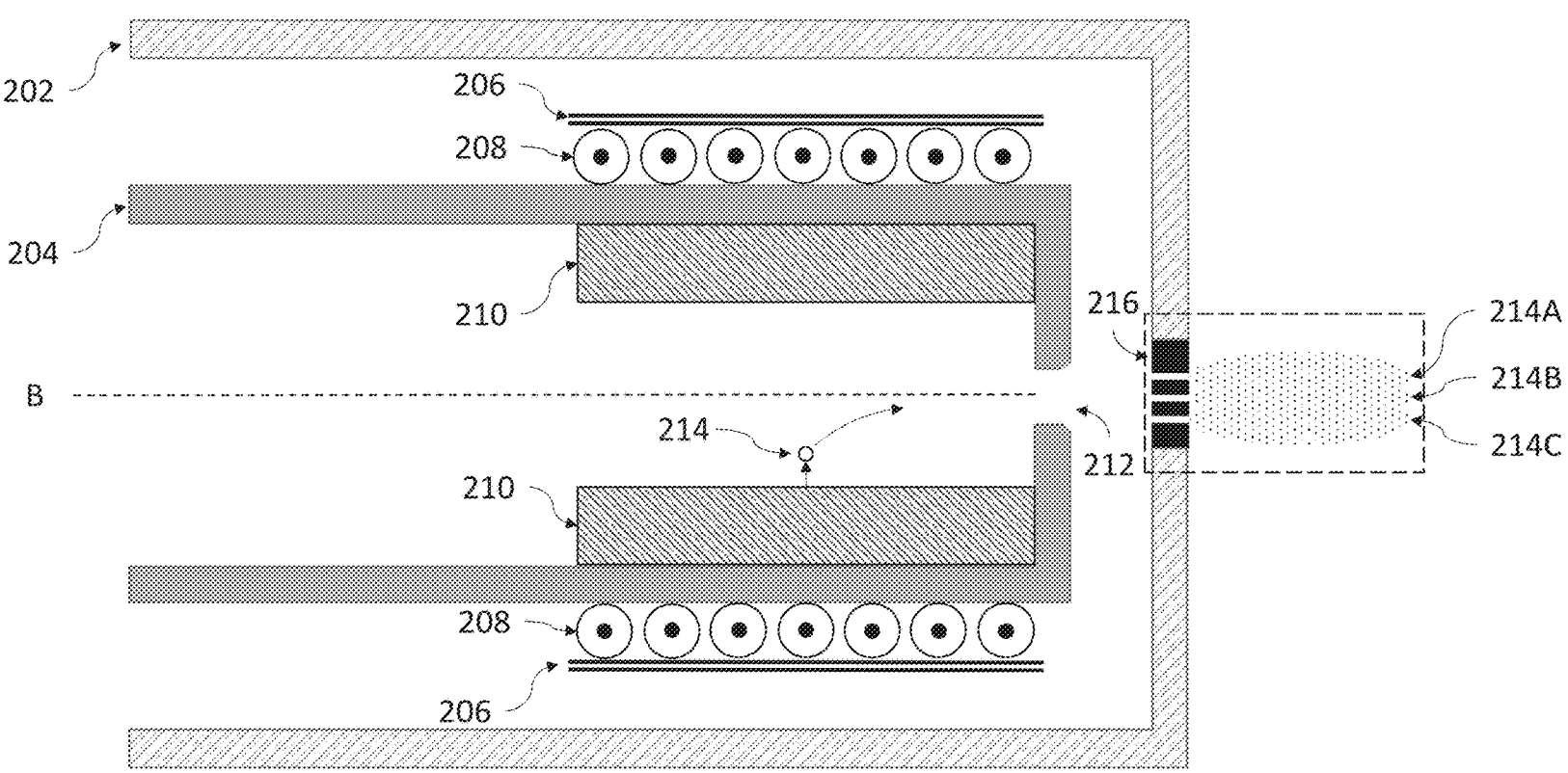
FIG. 2 is a cross-sectional view of a hollow cathode according to one embodiment.

FIG. 2 is a cross-sectional view of a hollow cathode 200 according to one embodiment. A cathode tube 204 is provided which includes a cathode insert disposed on an inner periphery on the cathode tube 204 and near one end of the cathode tube 204. The cathode tube is formed of a conducting material with sufficient strength to withstand qualification for spaceflight and sufficient temperature range to withstand cathode operation. Exemplary materials meeting this requirements are graphite or a refractory metal, such as molybdenum or tantalum. However, for lower temperature emitters, stainless steel or titanium can be used. Insert 210 is the active electron emitter. As one of ordinary skill in the art will understand, the insert 210 may be made from several different materials that provide a low work function surface on an interior surface, which is a surface of the insert 210 that is proximate to an axis B running through tube 204. The cathode tube 204 may be surrounded by a heater 208 that raises the temperature of the insert 210 to emissive temperatures to begin electron discharge. In one embodiment, heater 208 comprises a resistive element (e.g., a wire/coil) which receives current to produce heat. A heat shield 206 may be provided surrounding the heater 208. The heat shield 206 may be made of a roll of thin refractory metal foil, like tantalum or molybdenum. In an alternative embodiment, the heat shield 206 may be built integrally into keeper 202. An opening 212 is provided to allow electrons emitted from surface 210 to travel towards a keeper 202. Keeper 202 surrounds the cathode tube 204, heat shield 206, and heater 208, and is made of higher temperature conducting material capable of surviving plasma sputtering for the duration of the cathode lifetime. Exemplary materials for forming keeper 202 include molybdenum, tantalum, stainless steel, and graphite. Keeper 202 also includes a keeper orifice 216. The keeper orifice 216 may be integrally formed in the keeper 202 or may be a plate that is connected to the keeper 202 through a connector (e.g., bolts or screws). Keeper 202 is positively biased to draw electrons emitted from the insert 210 toward and through the keeper orifice 216. The region surrounding the keeper orifice 216 (indicated by the dashed box in FIG. 2) is explained in detail in FIG. 3.

Figure 3:
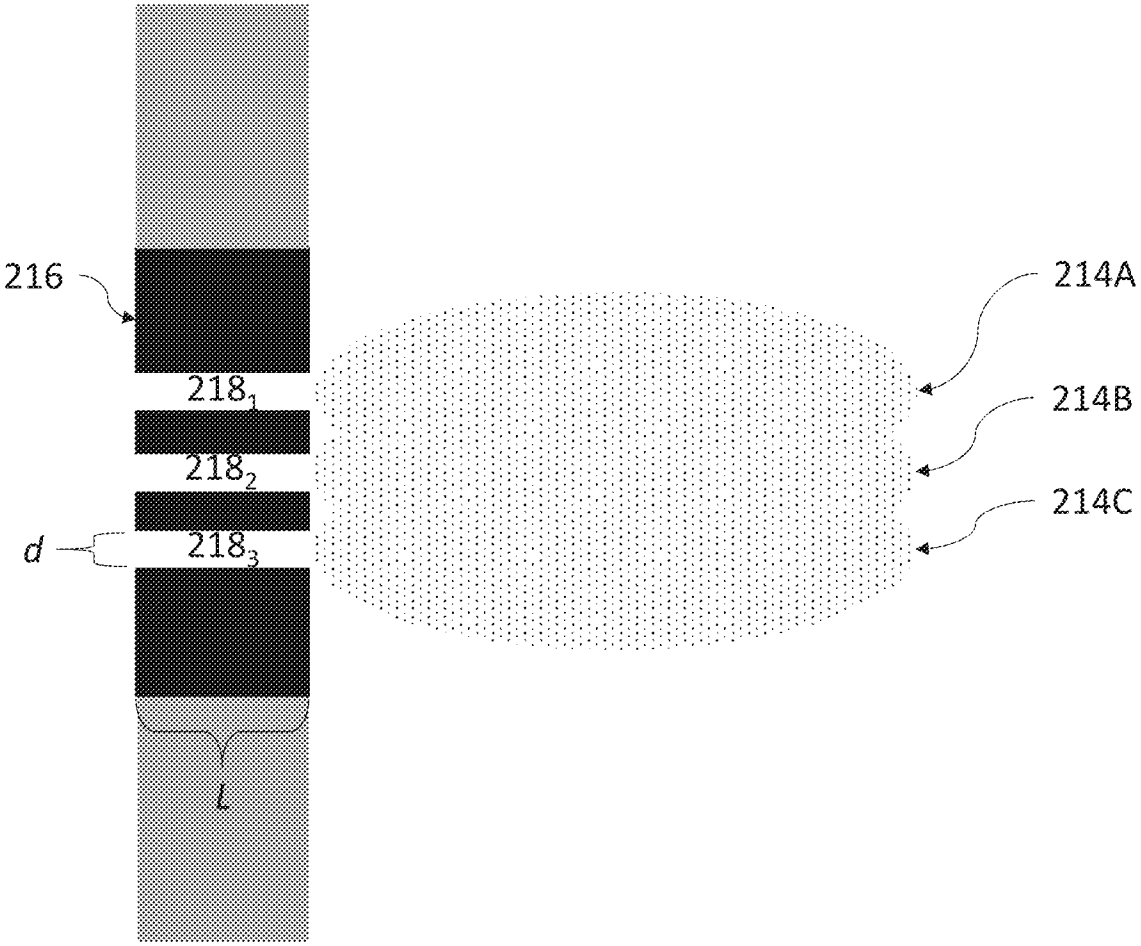
FIG. 3 is a cross-sectional view of the hatched area in FIG. 2.

FIG. 3 is a cross-sectional view of a region of cathode keeper 202 that includes a keeper orifice 216. Unlike prior art devices, orifice 216 includes a plurality of openings 218A-C through which electrons 214 emitted from the insert 210 may travel through and leave the hollow cathode 200. While in one embodiment, the plurality of openings 218A-C may be straight, due to plasma effects the ends will often become rounded. For straight openings, arc attachment may occur which could melt a sharp corner and create debris and/or risk of electrical shorts. As such, in a preferred embodiment, openings 218A-C (and openings $\mathbf{218}_{ij}$ described below) have filleted or chamfered edges to create a flared opening that reduces the sharpness of the corners. In FIG. 3, three openings 218A-C are shown with three corresponding electron plumes 214A-C, however, this number is merely exemplary. As explained further below, far more than three openings may be provided. Each opening has a length L, along an axial direction, and diameter d, as measured perpendicular to the axial direction. While those skilled in the art will recognize that plasma conductivity through a volume of space depends on many factors, for illustration we consider electrons passing through the keeper orifice as passing down a wire of uniform conductivity such that electrical conductance through the opening is proportional to $$\left(\frac{d^2}{L}\right).$$

That is, the electrical resistance to current passing through the opening decreases with the square of the diameter. A larger opening means less resistance to an electron 214 passing through the opening which means a higher electrical conductance (lower resistance). Conversely, a smaller opening means greater resistance to an electron 214 passing through the opening which means a lower electrical conductance (higher resistance). Gas conductance behaves in a similar manner where those skilled in the art will recognize that an exact value is typically determined by numerical modeling but reasonable approximations give analytical expressions proportional to $$\left(\frac{d^3}{L}\right)$$

for molecular flow and $$\left(\frac{d^4}{L}\right)$$

for continuum (higher pressure) flow. That is, the transmission of gas particles decreases with the cube or even the fourth power of the diameter. A smaller opening means fewer gas particles can escape (lower gas conductance). In the case of single orifice, there is only one diameter. Thus, for a given length L, varying d affects both electrical conductance and gas conductance. In other words, gas and electrical conductance are coupled. However, by providing a plurality openings $\mathbf{218}_i$ electrical conductance can be decoupled from gas conductance, as explained below.

When a plurality of openings $\mathbf{218}_i$ are provided in orifice 216, the electrical conductance is proportional to the total area of the openings $\mathbf{218}_i$. In other words, for an orifice with a plurality of openings (such as 216) the effective diameter for purposes of electrical conductance ($d_{electrical\ eff}$) is the same as the diameter of an opening with an area equal to the area of the plurality of openings. However, this is not true for purposes of gas conductance. The smaller diameters of the plurality of openings $\mathbf{218}_i$ significantly curtail the flow of gas through the plurality of openings $\mathbf{218}_i$ such that the total gas conductance of the plurality of openings $\mathbf{218}_i$ is less than the gas conductance of a single opening with an area equal to the total area of the plurality of openings $\mathbf{218}_i$. Thus, while electrical conductance in the case of a plurality of openings $\mathbf{218}_i$ is similar to a case of a single opening of equal area, gas conductance is profoundly different. This results in a decoupling of electrical conductance and gas conductance.

Figure 4:
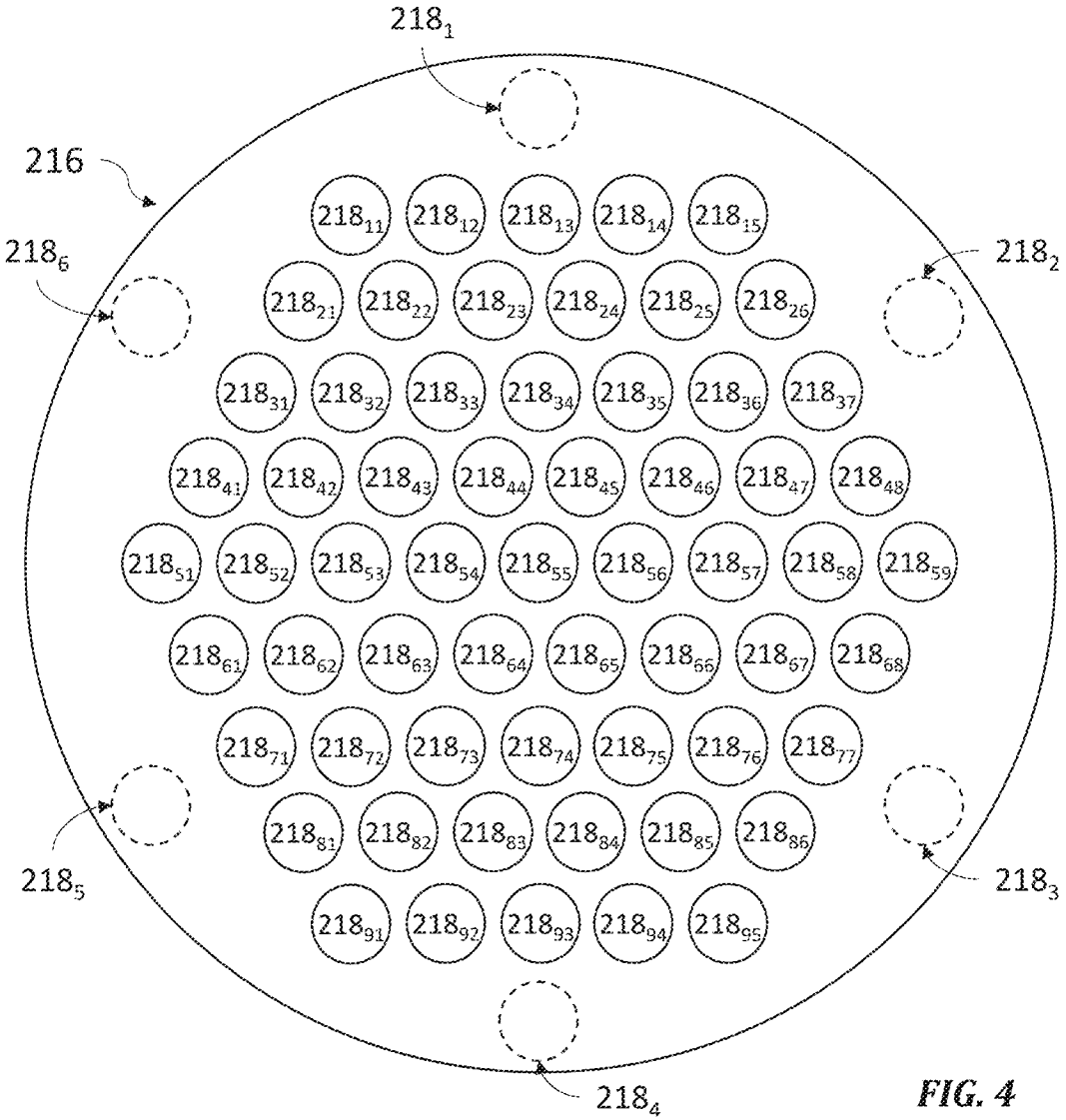
FIG. 4 is a plan view of an orifice/orifice plate 216 according to one embodiment.

FIG. 4 is a plan view of keeper orifice 216 according to one embodiment. In this embodiment 61 openings ($\mathbf{218}_{11}$ . . . $\mathbf{218}_{95}$) are shown and arranged in a hexagonal packing pattern, however that number of openings is merely exemplary as described below. Moreover, the hexagonal packing pattern is illustrative of one embodiment. Other packing patterns may be used including, for example, square packing. In addition, subsets of such packing not in a full hexagon or square shape may also be used, for example, an equilateral triangle of just three holes, or a rectangular array of holes with unequal rows and columns. In FIG. 4, the openings are identified by the following format $\mathbf{218}_{ij}$ where "i" denotes a row number and "j" denotes a column number. A central opening $\mathbf{218}_{55}$, in this embodiment, is arranged in a centered position of orifice 216 such that when orifice 216 is installed on keeper 202 it is coaxial with axis B. The openings $\mathbf{218}_{ij}$ may also be described as within rings. The first ring contains a single opening $\mathbf{218}_{55}$. The second ring contains 6 openings ($\mathbf{218}_{45}$, $\mathbf{218}_{56}$, $\mathbf{218}_{65}$, $\mathbf{218}_{64}$, $\mathbf{218}_{54}$, and $\mathbf{218}_{44}$). Thus the total number of openings $\mathbf{218}_{ij}$ is 7 for the first and second rings. Each additional ring adds six additional openings to the number from the previous ring. Thus, a third ring that includes opening $\mathbf{218}_{33}$ has 12 openings. Thus, the total number of openings from rings 1-3 is 19. This pattern can be expressed by Equation 1 below:

$$N_{openings} = 1 + \sum_{i=2}^{N_{rings}} 6(i-1)$$

In a preferred embodiment, the diameter of the openings $\mathbf{218}_{ij}$ is between 10-60% (inclusive) of the effective diameter of a single hole of equal total area (defined earlier as $d_{electrical\ eff}$), in a more preferred embodiment the range is 20-50%. In both cases, aspect ratios $$\left(\frac{L}{d}\right)$$

range up to 5. An exemplary lower limit of the aspect ratio is driven by the minimum value for L to preserve mechanical robustness of the keeper and may be on the order of ¼. The minimum diameter d is set by the requirement that an opening $\mathbf{218}_{ij}$ be several times larger than the plasma sheath thickness over the keeper surface. The plasma sheath in a cathode is several Debye lengths thick, where the Debye length is a well-known plasma property depending on the plasma density and electron temperature. For too small an opening the plasma sheath will "shield" any outside potential from influencing the plasma inside the opening, preventing use in a larger plasma device such as a Hall thruster where one must draw electrons out through the openings to the rest of the plasma using electric fields. For common hollow cathode plasma densities the Debye length ranges from a few to a few tens of microns, thus a suitable minimum diameter may be as low as 100 microns, depending on the anticipated plasma environment. Openings $\mathbf{218}_{ij}$ with these characteristics may be fabricated by electrical discharge machining (EDM), conventional drilling with a precision bit and mill, or the orifice plate or entire keeper may be 3D printed. The spacing between the openings $\mathbf{218}_{ij}$, that is the closest straight line distance between two openings $\mathbf{218}_{ij}$ is chosen to balance mechanical robustness and strength with a desire to keep the holes closely packed to provide efficient extraction of the plasma over the central exit of the tubular electron emitter. Too high a packing fraction, however, renders the area where the openings $\mathbf{218}_{ij}$ are located fragile and subject to failure. Using the opening diameter as a measurement yardstick, the minimum center-to-center spacing where the edge of each opening $\mathbf{218}_{ij}$ touches its neighbor corresponds to a spacing of one diameter. The minimum practical spacing to provide material for the webbing between openings is about 1.1 times the diameters of the openings $\mathbf{218}_{ij}$, while the maximum practical spacing before the benefits of the holes are lost is about 4 times the diameter of the openings $\mathbf{218}_{ij}$, with preferred spacings between openings $\mathbf{218}_{ij}$ being between 1.25 and 3 times the diameter of the opening $\mathbf{218}_{ij}$.

As discussed above, orifice 216 may be integrally formed into keeper 202, or may include a plurality of threaded openings $\mathbf{218}_1$ . . . $\mathbf{218}_6$ disposed on a circumferential periphery of orifice 216 that allow orifice 216 to be fasten to the keeper 202 using bolts or screws, as illustrated in FIGS. 5A-B and FIGS. 6A-B.

Figure 5A:
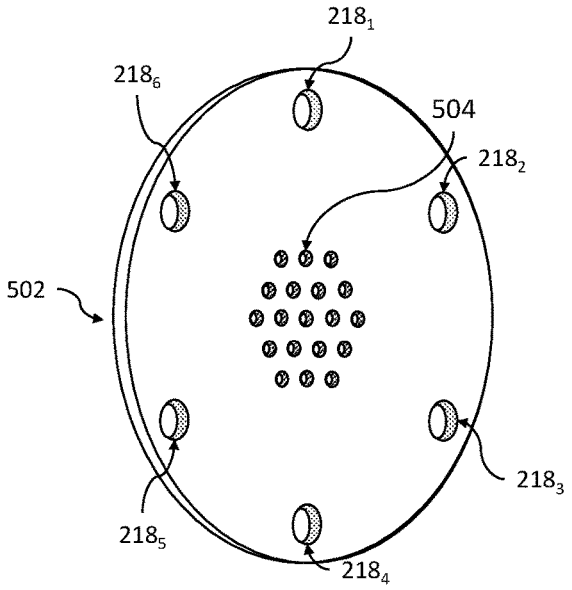
FIG. 5A is a perspective view of an orifice plate 216 according to one embodiment.
Figure 5B:
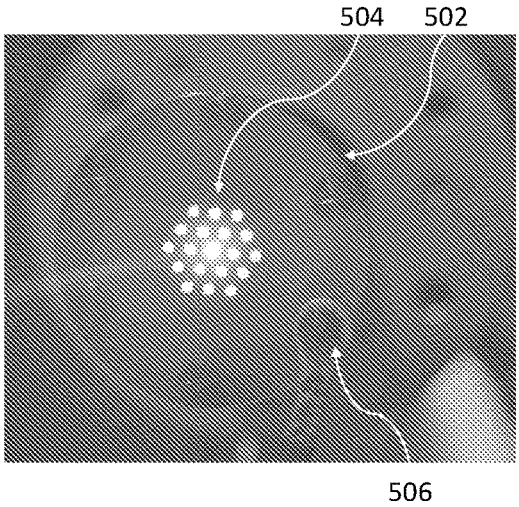
FIG. 5B is a perspective view of the orifice plate 216 shown in FIG. 5A in operation.

FIG. 5A is a perspective view of an orifice plate 502 according to one embodiment. In this embodiment, 3 rings of openings 504 are provided in a hexagonal packing pattern for a total of 19 openings. FIG. 5B shows the orifice plate 502 of FIG. 5A connected to a keeper (not shown) and in operation. In FIG. 5B the positive voltage applied to the keeper is provided by an external wire 506 that is held fixed in place by a connector (e.g., a bolt or screw) that is inserted into one of the threaded openings $\mathbf{218}_i$. However, this is merely exemplary and the keeper may receive its bias for another location.

Figure 6A:
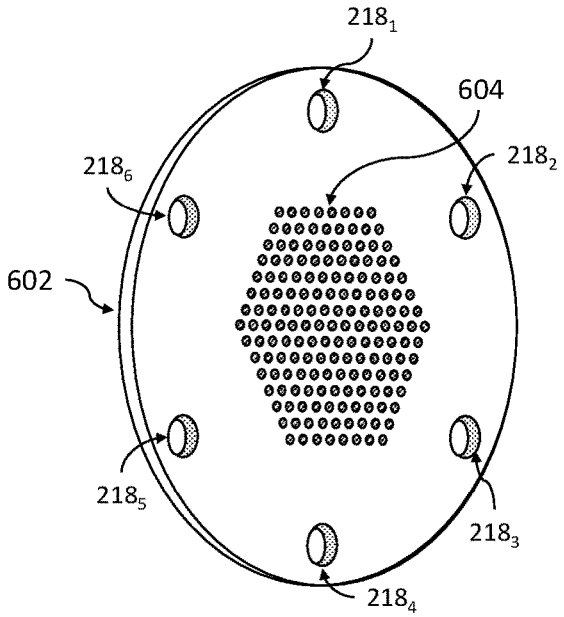
FIG. 6A is a perspective view of an orifice plate 216 according to another embodiment.
Figure 6B:
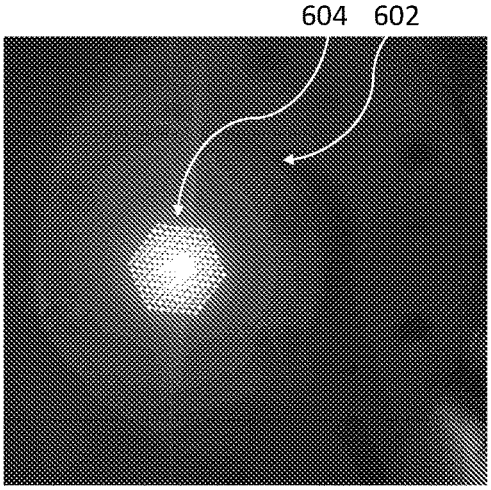
FIG. 6B is a perspective view of the orifice plate 216 shown in FIG. 6A in operation.

FIG. 6A is a perspective view of an orifice plate 602 according to another embodiment. In this embodiment, 8 rings of openings 604 are provided in a hexagonal packing pattern for a total of 169 openings. FIG. 6B shows the orifice plate 602 of FIG. 6A connected to a keeper (not shown) and in operation.

Figure 7:
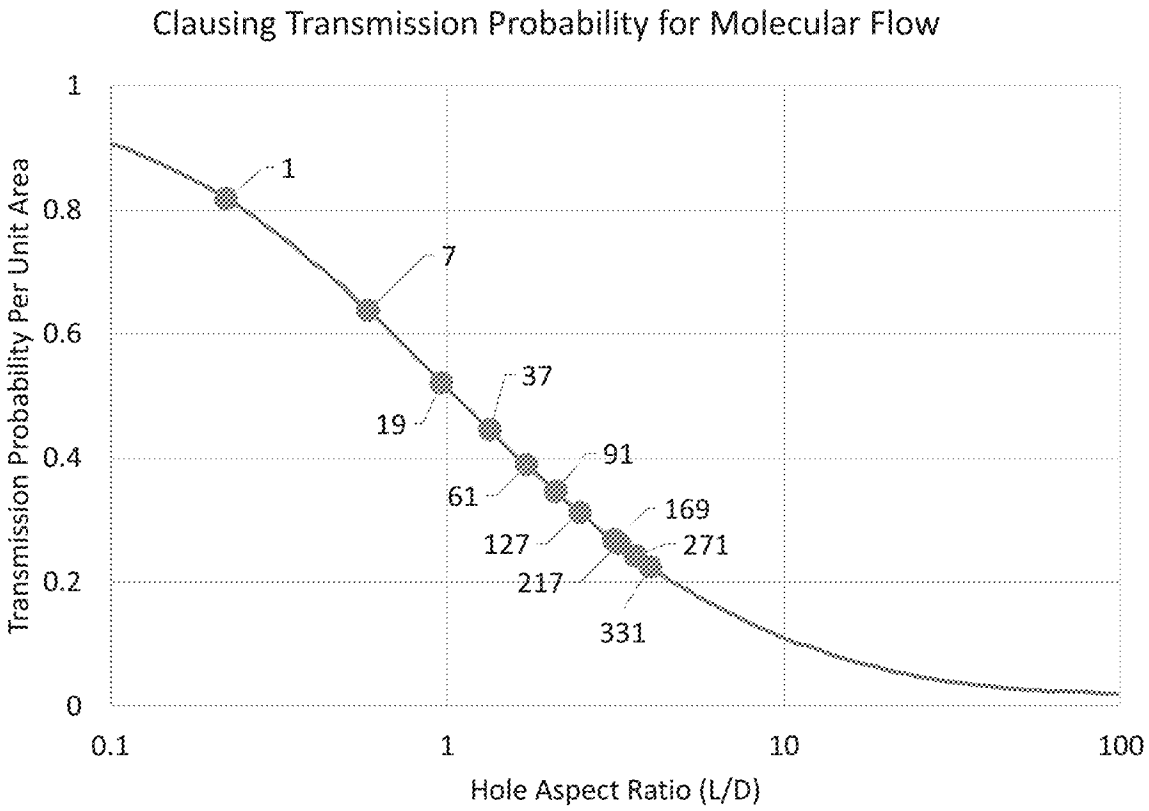
FIG. 7 is a plot of transmission probability versus aspect ratio for a plurality of orifice plates 216 with openings from 1-331.

FIG. 7 is a plot of Clausing transmission probability for molecular flow for an orifice plate 216 that comprises 1-331 openings $\mathbf{218}_{ij}$ (arranged in a hexagonal packing pattern) and has an aspect ratio $$\left(\frac{L}{d}\right)$$

indicated by the x-axis. Given an initial assumed aspect ratio $$\left(\frac{L}{d}\right)$$

~¼ for a single opening, the aspect ratio $$\left(\frac{L}{d}\right)$$

for larger numbers of openings with the same total area is computed using fixed L while d is adjusted to preserve area. The y-axis shows the transmission probability per unit area of each openings. The probability that a gas molecule will pass through an opening $\mathbf{218}_{ij}$ is highest when the opening is largest, which corresponds to the single orifice implementation. In general, however, the transmission probability declines as more openings $\mathbf{218}_{ij}$ are introduced which means less gas is being transmitted through the openings $218_{ij}$. In general, the difficulty in forming the openings in orifice plate 216 increases as the number of holes increase, because as the diameter of the holes becomes smaller every finer machining is required. As discussed above, a lower transmission probability means less gas is transmitted through the orifice, which lowers the gas flow required to sustain the minimum pressure for ignition. Gas conductance, however, is not the only important factor.

Figure 8:
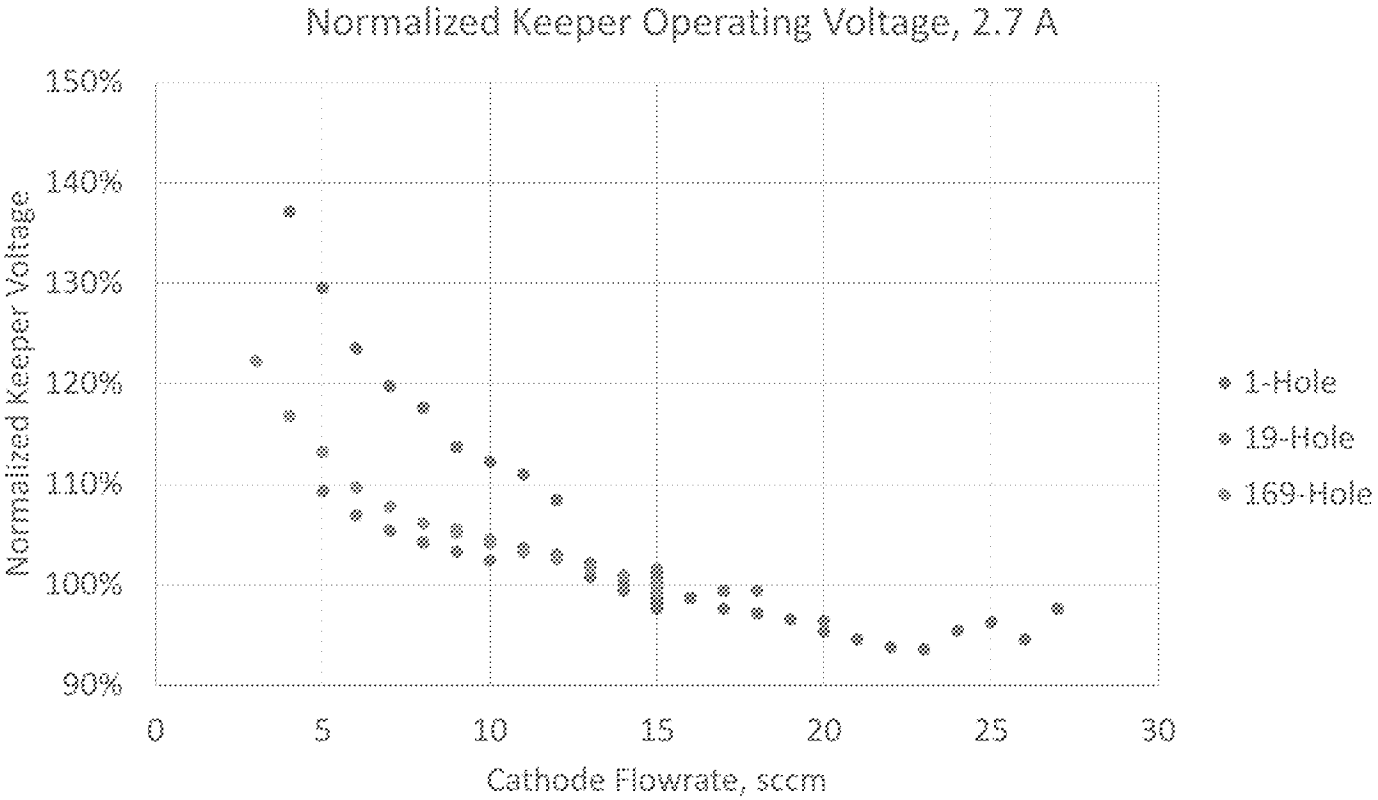
FIG. 8 is a plot of normalized keeper operating voltage to cathode flowrate for orifice plates with 1, 19, and 169 openings.

FIG. 8 shows a plot of normalized keeper voltage versus cathode flowrate for argon for a hollow cathode 102 that includes an orifice plate 216 that includes a single opening (the prior art), and the 19 and 169 openings embodiments shown in FIGS. 5A-6B. The keeper operating voltages are normalized to the steady operating values obtained at high flowrate in order to better illustrate relative trends between the orifice configurations at lower flowrates. The absolute voltages are discussed below and in FIG. 9. FIG. 8 shows that expected performance deterioration (i.e., higher voltage operation) at reduced flowrate is delayed toward lower flowrates by breaking the single keeper orifice into multiple orifices. For example, reducing flow from 15 standard cubic centimeters per minute (sccm) to 5 sccm produces a 30% increase in voltage in the single keeper orifice case, while producing only a 10-15% increase in voltage in the multiply orificed cases. In a setting where gas supply is limited that advantage is significant.

Figure 9:
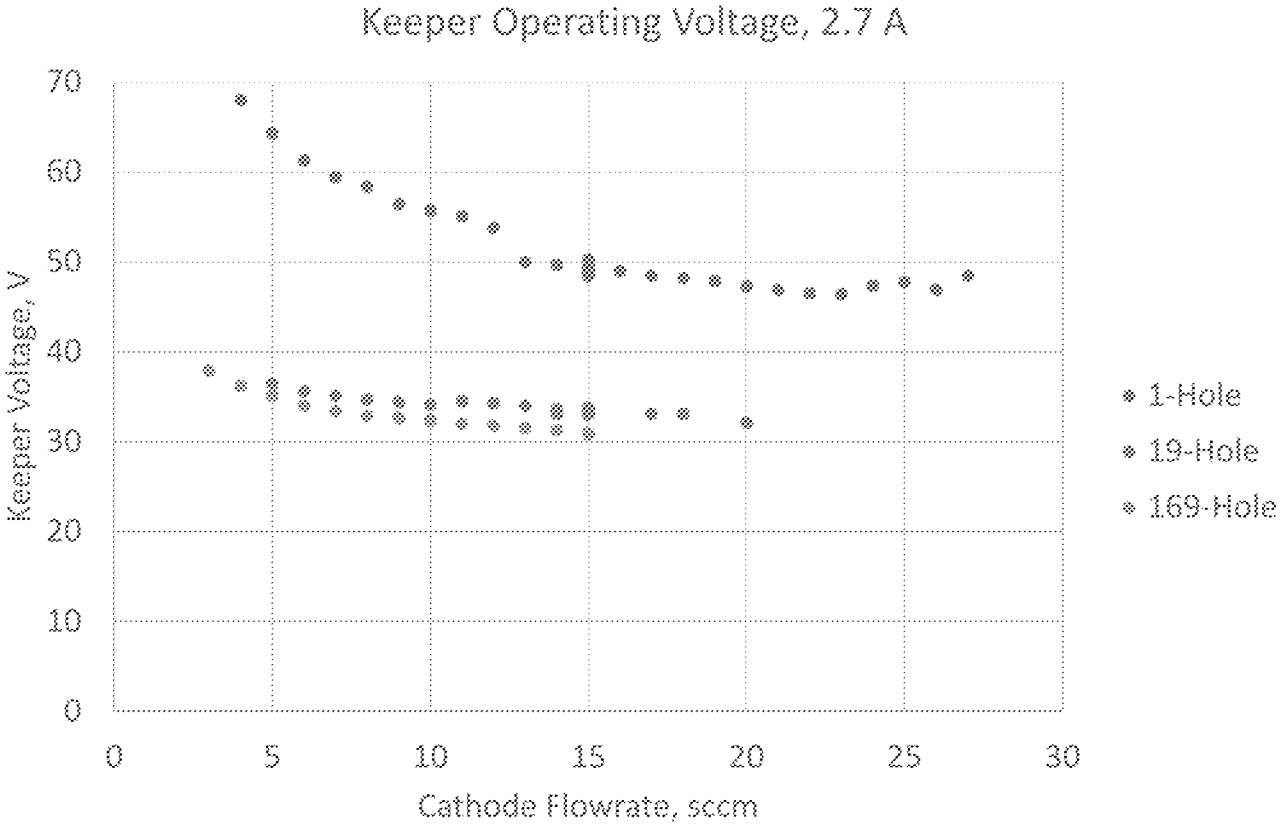
FIG. 9 is a plot of keeper operating voltage to cathode flowrate for orifice plates with 1, 19, and 169 openings.

FIG. 9 shows the same data as in FIG. 8, but without normalization. It is a plot of keeper voltage versus cathode flowrate for argon for a hollow cathode 200 that includes an orifice plate 216 that includes a single opening (the prior art), and the 19 and 169 openings embodiments shown in FIGS. 5A-6B. This shows the entirely unexpected result that due to the decreased gas conductance and thus higher pressure inside the cathode, a significantly lower keeper voltage is required to ignite and sustain the discharge of electrons. For example, with respect to the 19 opening embodiment, a nearly 50% reduction in keeper voltage to sustain the discharge is obtained. For the 169 opening embodiment, an even greater reduction in keeper voltage is obtained. However, considering the increased difficult in manufacturing an orifice plate with 169 openings $218_{ij}$, it may be preferable to accept the slightly higher voltage requirements of the 19 opening embodiment. Regardless of which embodiment is chosen, however, the near 50% reduction in keeper voltage means that a thruster that employs a hollow cathode 202 that includes an orifice plate with multiple openings, as described above, will consume less power than one that uses a single orifice. In a setting where power is limited, that advantage is significant.

This result is even more is surprising because reducing orifice size in cathodes is typically expected to cause excessive resistance as too much electron current tries to force through the smaller passage, causing plasma heating that drives increased ion energy and associated sputtering or erosion. This ultimately widens the initially too-small orifice to a more acceptable size. Breaking the single keeper orifice into multiple orifices would have been expected to produce the same result as the electron current is concentrated through one or a few of the orifices rather than spreading out. However, the reduced operating voltage of the discharge indicates that this is unexpectedly not happening, and in fact has produced a fortuitous advantage in operating power efficiency in addition to the reduced gas flow.

While various example embodiments of the invention have been described above, it should be understood that they have been presented by way of example, and not limitation. It is apparent to persons skilled in the relevant art(s) that various changes in form and detail can be made therein. Thus, the disclosure should not be limited by any of the above described example embodiments, but should be defined only in accordance with the following claims and their equivalents.

In addition, it should be understood that the figures are presented for example purposes only. The architecture of the example embodiments presented herein is sufficiently flexible and configurable, such that it may be utilized and navigated in ways other than that shown in the accompanying figures.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the example embodiments presented herein in any way. It is also to be understood that the procedures recited in the claims need not be performed in the order presented.

What is claimed is:

1. A cathode, comprising:

a cathode tube constructed to emit electrons;

a keeper constructed to receive a positive bias to draw electrons emitted from the cathode tube; and a keeper orifice plate that includes a plurality of openings and is connected to the keeper, wherein the plurality of openings decouple gas conductance and electrical conductance across the keeper orifice plate, and wherein diameters of the plurality of openings are within a range of 20% -60%, inclusive, of a diameter of a circle with an area equal to a sum of areas of the plurality of openings.

2. The cathode of claim 1, wherein the keeper comprises molybdenum, tantalum, stainless steel or graphite.

3. The cathode of claim 1, wherein at least one end of each of the plurality of openings is flared.

4. The cathode of claim 1, wherein the plurality of openings are arranged in one of a hexagonal packing pattern, a rectangular packing pattern, or a triangular pattern.

5. The cathode of claim 1, wherein the plurality of openings are arranged in a plurality of rings where a single opening, of the plurality of openings, is defined as a central opening and the plurality of rings are arranged around the central opening.

6. The cathode of claim 1, wherein each of the plurality of openings has an aspect ratio defined by a length of the opening divided by a diameter of the opening, where the length of the opening is measured perpendicular to a surface of the keeper orifice plate, and the aspect ratios for the plurality of openings are between ¼-5, inclusive.

7. The cathode of claim 1, wherein diameters of the plurality of openings are between 100 microns and 500 microns, inclusive.

8. The cathode of claim 1, wherein a center-to-center spacing between the plurality of openings is between 1.1 times a diameter of the plurality of openings to 4 times the diameter of the plurality of openings, inclusive.

9. The cathode of claim 1, wherein a center-to-center spacing between the plurality of openings is between 1.25 times the diameter of the plurality of openings and 3 times the diameter of the plurality of openings, inclusive.

10. A cathode, comprising:

a cathode tube constructed to emit electrons; and a keeper constructed to receive a positive bias to draw electrons emitted from the cathode tube, wherein the keeper includes an orifice that includes a plurality of openings, wherein the plurality of openings decouple gas conductance and electrical conductance across the keeper orifice, and wherein diameters of the plurality of openings are within a range of 20% -60%, inclusive, of a diameter of a circle with an area equal to a sum of areas of the plurality of openings.

11. The cathode of claim 10, wherein the keeper comprises molybdenum, tantalum, stainless steel or graphite.

12. The cathode of claim 10, wherein at least one end of each of the plurality of openings is flared.

13. The cathode of claim 10, wherein the plurality of openings are arranged in one of a hexagonal packing pattern, a rectangular packing pattern, or a triangular pattern.

14. The cathode of claim 10, wherein the plurality of openings are arranged in a plurality of rings where a single opening, of the plurality of openings, is defined as a central opening and the plurality of rings are arranged around the central opening.

15. The cathode of claim 10, wherein each of the plurality of openings has an aspect ratio defined by a length of the opening divided by a diameter of the opening, where the length of the opening is measured perpendicular to a surface of the keeper orifice, and the aspect ratios for the plurality of openings are between 0.25-5, inclusive.

16. The cathode of claim 10, wherein diameters of the plurality of openings are between 100 microns and 500 microns, inclusive.

17. The cathode of claim 10, wherein a center-to-center spacing between the plurality of openings is between 1.1 times a diameter of the plurality of openings to 4 times the diameter of the plurality of openings, inclusive.

18. The cathode of claim 10, wherein a center-to-center spacing between the plurality of openings is between 1.25 times the diameter of the plurality of openings to 3 times the diameter of the plurality of openings, inclusive.

* * * * *